US008016565B2

(12) United States Patent
Berg et al.

(10) Patent No.: US 8,016,565 B2
(45) Date of Patent: Sep. 13, 2011

(54) METHODS AND APPARATUS FOR ASSEMBLING GAS TURBINE ENGINES

(75) Inventors: Richard Hiram Berg, Hilton, NY (US); Mark Stefan Maier, Greer, SC (US)

(73) Assignee: General Electric Company, Schenectady, NY (US)

( * ) Notice: Subject to any disclaimer, the term of this patent is extended or adjusted under 35 U.S.C. 154(b) by 1379 days.

(21) Appl. No.: 11/756,190

(22) Filed: May 31, 2007

(65) Prior Publication Data

US 2010/0068063 A1 Mar. 18, 2010

(51) Int. Cl.
*F03B 3/12* (2006.01)

(52) U.S. Cl. ..... 416/219 R; 416/248

(58) Field of Classification Search ..... 416/219 R, 416/220 R, 221, 248; 277/641
See application file for complete search history.

(56) References Cited

U.S. PATENT DOCUMENTS

| | | | | | |
|---|---|---|---|---|---|
| 900,739 | A | * | 10/1908 | Jude et al. | 416/217 |
| 2,315,574 | A | * | 4/1943 | Anderson | 416/205 |
| 2,317,338 | A | * | 4/1943 | Rydmark | 416/221 |
| 2,350,345 | A | * | 6/1944 | Freedman et al. | 416/209 |
| 2,430,185 | A | * | 11/1947 | Prescott | 416/220 R |
| 2,686,655 | A | * | 8/1954 | Schorner | 416/214 R |
| 2,753,149 | A | * | 7/1956 | Kurti | 416/216 |
| 2,801,074 | A | * | 7/1957 | Brown | 416/221 |
| 2,847,187 | A | * | 8/1958 | Murphy | 416/221 |
| 3,076,634 | A | * | 2/1963 | Boyle et al. | 416/221 |
| 3,158,353 | A | * | 11/1964 | Salt et al. | 416/220 R |
| 4,022,545 | A | * | 5/1977 | Shank | 416/221 |
| 4,500,098 | A | * | 2/1985 | Wilcox et al. | 277/641 |
| 4,820,126 | A | * | 4/1989 | Gavilan | 416/221 |
| 5,137,420 | A | * | 8/1992 | Sigworth et al. | 415/170.1 |
| 5,257,909 | A | | 11/1993 | Glynn et al. | |
| 5,388,962 | A | | 2/1995 | Wygle et al. | |
| 5,435,694 | A | * | 7/1995 | Kray et al. | 416/219 R |
| 5,558,500 | A | | 9/1996 | Elliott et al. | |
| 5,630,703 | A | | 5/1997 | Hendley et al. | |
| 5,743,713 | A | | 4/1998 | Hattori et al. | |
| 5,833,244 | A | | 11/1998 | Salt et al. | |
| 6,398,499 | B1 | | 6/2002 | Simonetti et al. | |
| 6,672,829 | B1 | | 1/2004 | Cherry et al. | |
| 7,090,466 | B2 | | 8/2006 | Honkomp et al. | |
| 2004/0115055 | A1 | * | 6/2004 | Murphy et al. | 416/218 |
| 2006/0038358 | A1 | * | 2/2006 | James | 277/641 |
| 2007/0014668 | A1 | * | 1/2007 | Engle | 416/220 R |

* cited by examiner

*Primary Examiner* — Edward Look
*Assistant Examiner* — Aaron R Eastman
(74) *Attorney, Agent, or Firm* — Armstrong Teasdale LLP

(57) ABSTRACT

A method of assembling a rotor assembly is provided. The method comprises forming at least one channel in a dovetail portion of at least one rotor blade assembly, wherein the rotor blade assembly includes an airfoil extending outwardly from the dovetail portion, inserting a sealing assembly within the at least one channel of the dovetail portion, and coupling the at least one rotor blade assembly to a rotor disk using the dovetail portion such that at least a portion of the sealing assembly is between the dovetail portion and the rotor disk.

13 Claims, 6 Drawing Sheets

METHODS AND APPARATUS FOR ASSEMBLING GAS TURBINE ENGINES

BACKGROUND OF THE INVENTION

This invention relates generally to gas turbine engines, and more specifically to methods and apparatus for assembling gas turbine engine components.

Accurate fabrication of engine components may be a significant factor in engine performance and engine efficiency. Specifically, when the component is a gas turbine engine blade, the fabrication of the blade may affect the overall performance and efficiency of the gas turbine engine. At least some known gas turbine engines include high and low pressure compressors, a combustor, and at least one turbine. The compressors compress air which is mixed with fuel and channeled to the combustor. The fuel/air mixture is then ignited to generate hot combustion gases, which are channeled to the turbine. At least some known turbines include a rotor assembly that includes at least one row of circumferentially-spaced rotor blades. Each rotor blade includes an airfoil that includes a pressure side coupled to a suction side at a leading edge and a trailing edge. Each airfoil extends radially outward from a rotor blade platform. At least some known rotor blades include a dovetail that extends radially inward from a shank coupled to the platform. The dovetail is used to mount the rotor blade within the rotor assembly to a rotor disk or spool. In at least some known gas turbine engines, a small gap may be defined between a lower surface of the dovetail and a lower surface of the rotor disk.

During operation, a pressure differential created between the rotor blade pressure side and the rotor blade suction side may result in an undesirable leakage flow between the upstream and downstream portions of the rotor. One such possible leakage path may be defined through the gap defined between the dovetail and the lower surface of the rotor disk groove in which the rotor blades are carried. If such leakage paths are not efficiently sealed, the leakage flow may have an adverse effect both on engine efficiency and engine performance.

BRIEF DESCRIPTION OF THE INVENTION

In one aspect, a method of assembling a rotor assembly is provided. The method comprises forming at least one channel in a dovetail portion of at least one rotor blade assembly, wherein the rotor blade assembly includes an airfoil extending outwardly from the dovetail portion, inserting a sealing assembly within the at least one channel of the dovetail portion, and coupling the at least one rotor blade assembly to a rotor disk using the dovetail portion such that at least a portion of the sealing assembly is between the dovetail portion and the rotor disk.

In another aspect, a blade assembly for use in a turbine engine is provided. The blade assembly comprises an airfoil, a dovetail, a platform extending between the dovetail and the airfoil, the dovetail comprising at least one channel defined in a lower surface of the dovetail, and a sealing assembly inserted within the at least one channel, the sealing assembly configured to facilitate sealing between the dovetail and a rotor disk.

In a further aspect, a sealing assembly is provided. The sealing assembly comprises a dynamic plate that is substantially U-shaped, the dynamic plate comprises a front surface comprising at least one contoured edge and a channel, a static plate slidably coupled to the dynamic plate wherein the static plate is substantially U-shaped, the static plate comprising an inner surface and a perimetrical flange coupled thereto and extending axially therefrom, the flange comprises an outer surface that is slidably coupled to the channel of the dynamic plate, and a rope seal removably coupled to the flange outer surface wherein the rope seal is substantially U-shaped.

DETAILED DESCRIPTION OF THE INVENTION

The present invention generally provides exemplary methods and apparatus for assembling a gas turbine engine. The embodiments described herein are not limiting, but rather are exemplary only. Although the present invention is described below in reference to its application in connection with a gas turbine engine, it should be apparent to those skilled in the art and guided by the teachings herein provided that with appropriate modification, the system and methods of the present invention can also be suitable for any engine, including, but not limited to, steam turbine engines. Moreover, it should be apparent to those skilled in the art that the present invention may apply to any type of rotor blade, such as, but not limited to, compressor rotor blades and/or turbine rotor blades. More specifically, the present invention may apply to any rotor blade where preventing the leakage of airflow between a gap defined between a rotor blade dovetail and a lower surface of a rotor disk is desired.

As used herein, the terms "manufacture" and "manufacturing" may include any manufacturing or fabrication process. For example, manufacturing processes may include grinding, finishing, polishing, cutting, machining, inspecting, and/or casting. The above examples are intended as exemplary only, and thus are not intended to limit in any way the definition and/or meaning of the terms "manufacture" and "manufacturing". In addition, as used herein, the term "component" may include any object to which a manufacturing process is applied. Furthermore, although the invention is described herein in association with a turbine engine, and more specifically for use with a rotor blade for a turbine engine, it should be understood that the present invention may be applicable to any component and/or any manufacturing process. Accordingly, practice of the present invention is not limited to the manufacture of rotor blades or other components of gas turbine engines.

Figure 1:
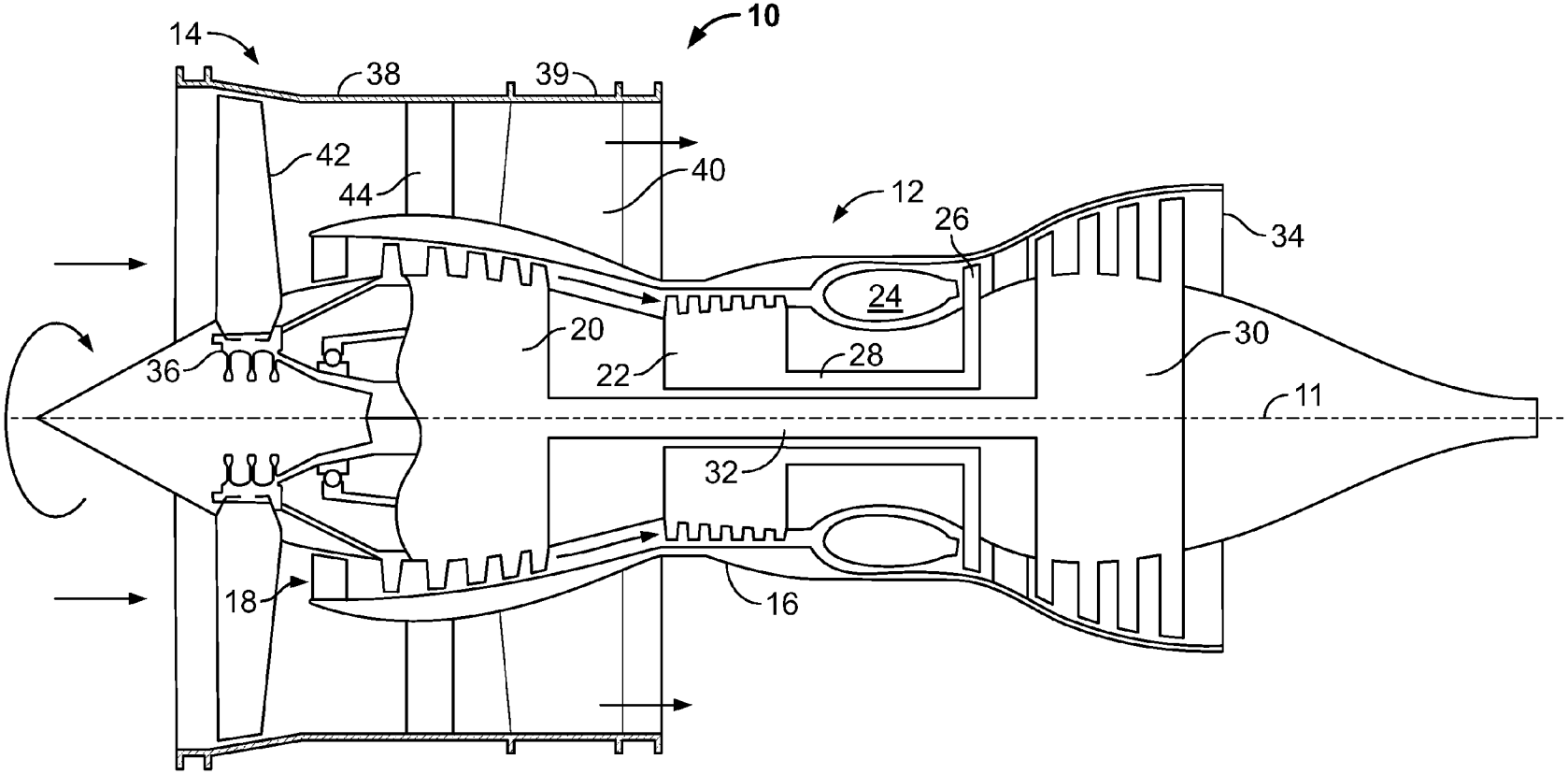
FIG. 1 is a schematic illustration of an exemplary gas turbine engine.

FIG. 1 is a schematic illustration of an exemplary turbine engine 10 having a longitudinal axis 11, and including a core turbine engine 12 and a fan section 14 coupled upstream of core engine 12. Core engine 12 includes an outer casing 16 that defines an annular core engine inlet 18. Casing 16 circumscribes a low-pressure booster 20 used to increase the pressure of incoming air to a first pressure level.

A high pressure, multi-stage, axial-flow compressor 22 receives pressurized air from booster 20 and further increases the pressure of the air to a second, higher pressure level. The high pressure air flows to a combustor 24 and is mixed with fuel. The fuel-air mixture is ignited to raise the temperature and energy level of the pressurized air. Combustion products generated are channeled to a first turbine 26 for driving compressor 22 through a first drive shaft 28, and subsequently to a second turbine 30 for driving booster 20 through a second drive shaft 32. Spent combustion gases are discharged from core engine 12 through an exhaust nozzle 34.

Fan section 14 includes a rotatable, axial-flow fan rotor 36 that is driven by second turbine 30. A fan casing 38 circumscribes fan rotor 36 and is supported from core engine 12 by a plurality of circumferentially-spaced support struts 44. Fan rotor 36 includes a plurality of circumferentially-spaced fan blades 42. Fan casing 38 extends rearwardly from fan rotor 36 over an outer portion of core engine 12 to define a secondary, or bypass airflow conduit. A casing element 39 that is downstream of and connected with fan casing 38 supports a plurality of fan stream outlet guide vanes 40. The air that passes through fan section 14 is propelled downstream by fan blades 42 to provide additional propulsive thrust to supplement the thrust provided by core engine 12.

Figure 2:
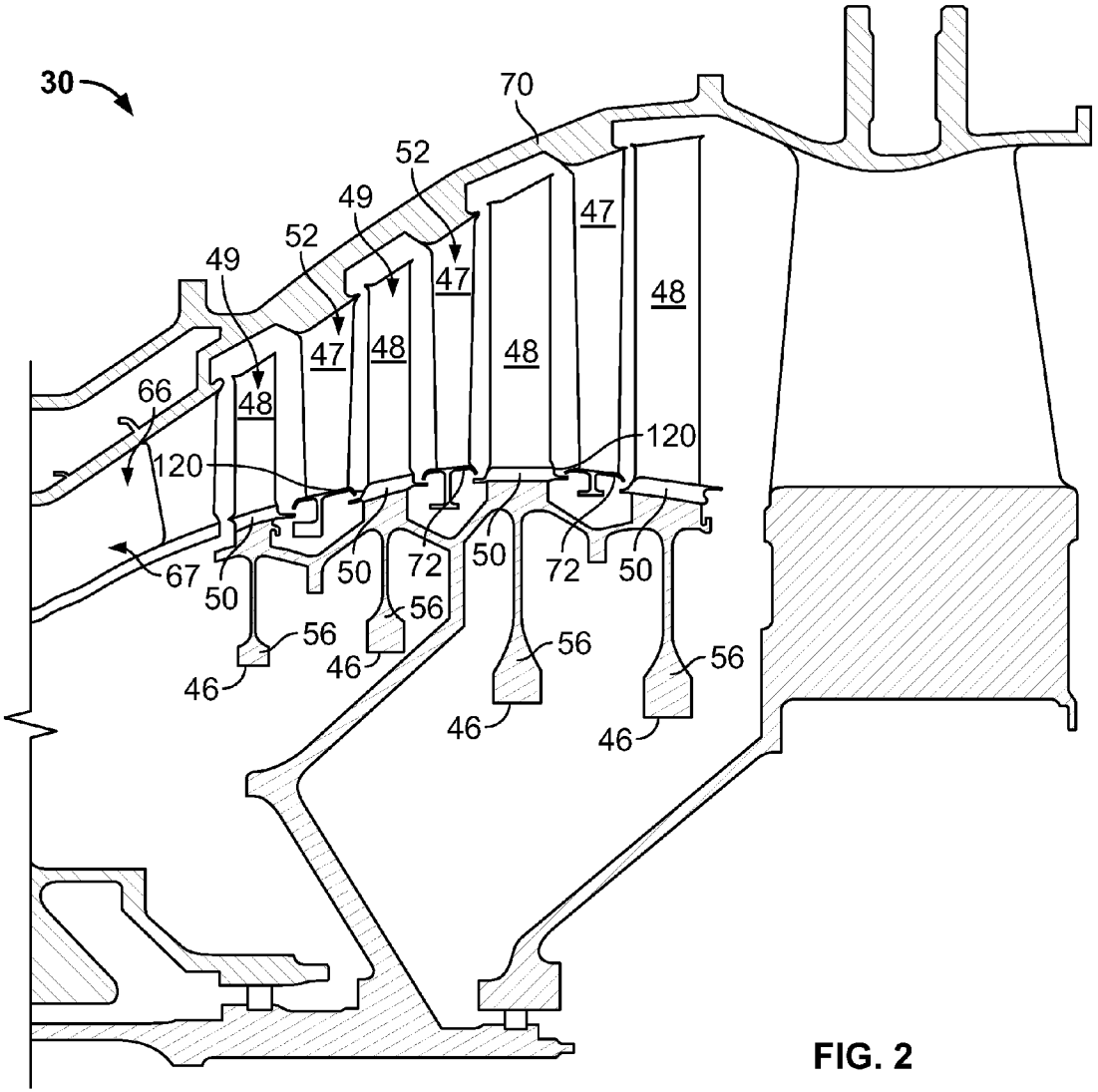
FIG. 2 is an enlarged cross-sectional view of a portion of the engine shown in FIG. 1.

FIG. 2 is an enlarged, cross-sectional view of a portion of exemplary second turbine 30. In the exemplary embodiment, turbine 30 includes a plurality of stages 46 that each includes a plurality of stator sections 52 and a plurality of rotor sections 49. Stator sections 52 each include a plurality of radially-extending, circumferentially-spaced stator vanes 47. Rotor sections 49 include a plurality of radially-extending, circumferentially-spaced rotor blades 48 coupled to a plurality of rotor disks 56. In the exemplary embodiment, rotor disks 56 include a plurality of circumferentially-spaced, axially-extending dovetail slots 50 that are configured to receive a corresponding plurality of rotor blades 48.

In the exemplary embodiment, turbine 30 also includes an inlet 66 that defines a flow passageway 67 through which combustion products may pass. An outer boundary of the flow passageway is defined by an outer annular casing 70 and an inner boundary of the flow passageway is defined by the blade platforms 120 of rotor blades 48 and also by a stationary annular seal ring 72.

In the exemplary embodiment, each stator section 52 includes an annular abradable seal (not shown) that is coupled to a respective annular sealing ring 72. The seal is oriented to be engaged by respective labyrinth seals (not shown) coupled to rotor disk 56 to facilitate minimizing air leakage around stators 52. Sealing rings 72 also facilitate restricting the flow of air to flow passageway 67.

Figure 3:
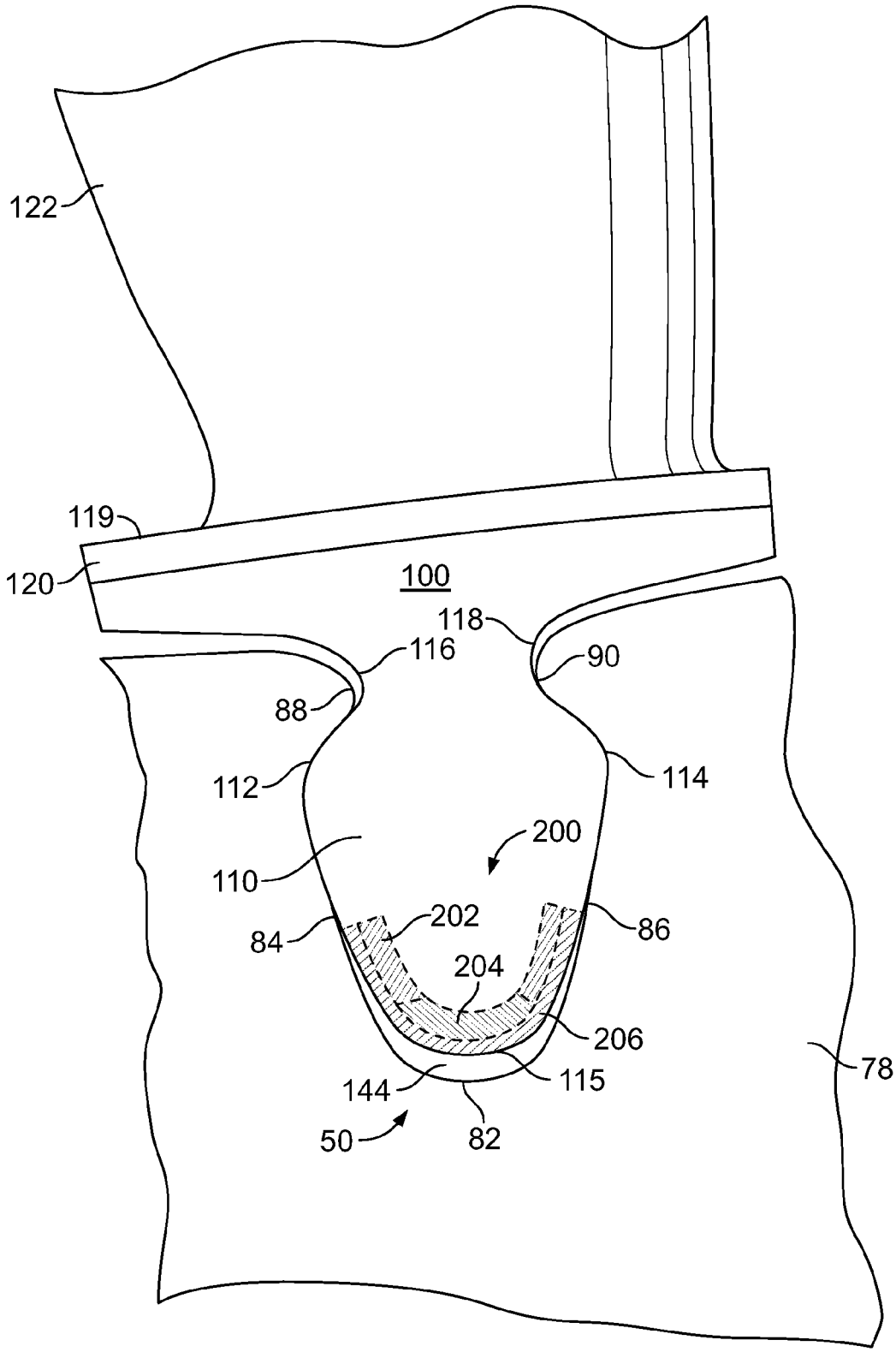
FIG. 3 is an end view of an exemplary gas turbine engine blade coupled to a disk which may be used with the engine shown in FIG. 1.
Figure 4:
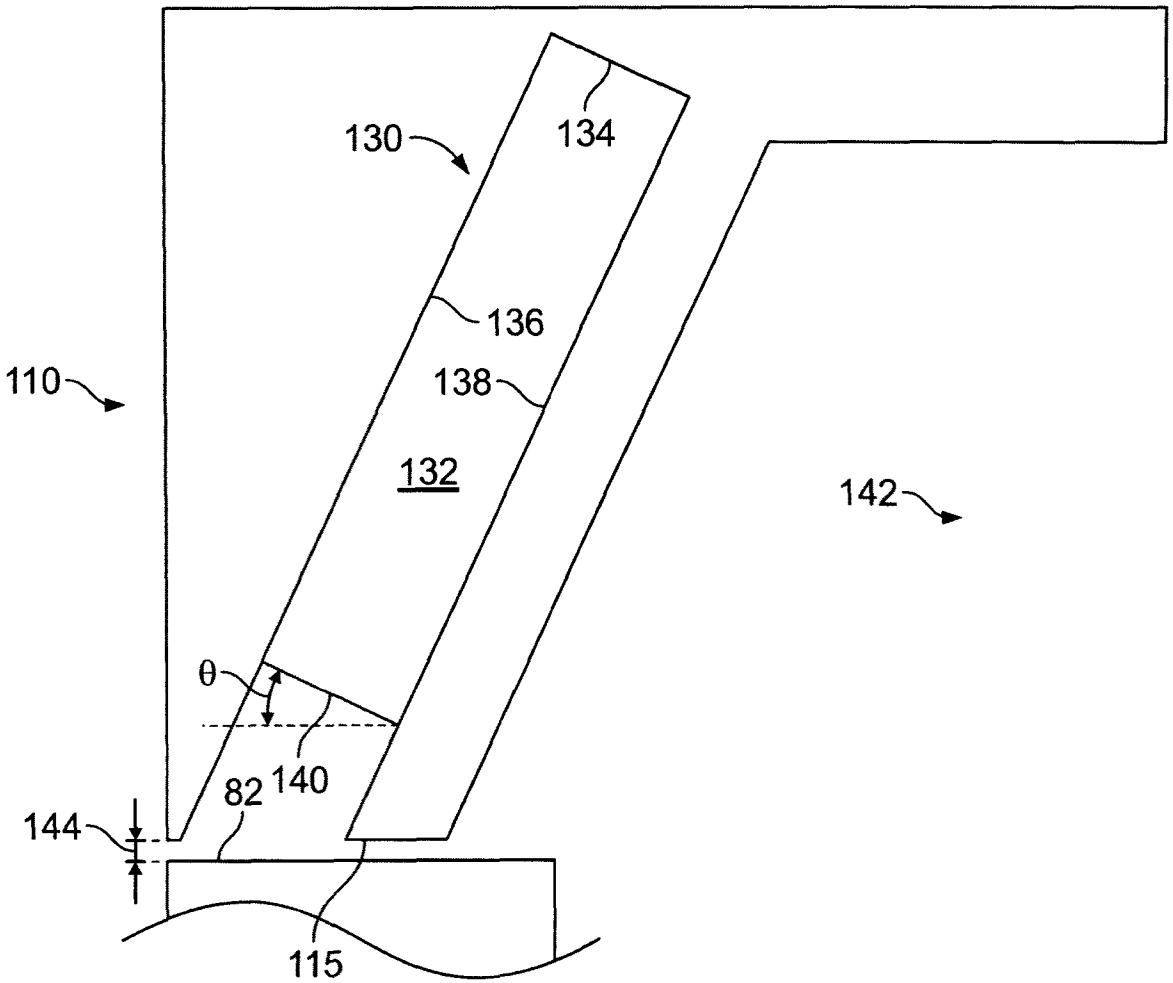
FIG. 4 is a cross-sectional side view of a portion of the blade shown in FIG. 3.

FIG. 3 is an end view of rotor disk 56 including a single rotor blade 48 coupled therein. FIG. 4 is a cross-sectional view of a portion of rotor blade 48. In the exemplary embodiment, rotor blades 48 each include a base portion 100, an airfoil portion 122, and a platform 120 extending therebetween. Specifically, in the exemplary embodiment, base portion 100 includes a dovetail 110. Platform 120 includes an upper surface 119 that is coupled to airfoil portion 122. Airfoil portion 122 extends radially outward from surface 119, into the flow path defined within engine 10.

In the exemplary embodiment, dovetail slots 50 are sized and shaped to receive rotor blades 48 therein. Specifically, slots 50 are sized and shaped to receive each rotor blade dovetail 110 therein. In the exemplary embodiment, slot 50 has a generally cross-sectional shape that is complimentary to the cross-sectional shape of the dovetail 110. Moreover, in the exemplary embodiment, slot sidewalls 84 and 86 are spaced apart from each other. In the exemplary embodiment, each sidewall 84 and 86 includes a respective inward convex projection 88 and 90, and a pair of recesses 112 and 114 that partially define the cross-sectional shape of slot 50.

In the exemplary embodiment, dovetail 110 includes a radially inner surface 115 and a pair of contoured sidewalls 116 and 118 that are spaced circumferentially from each other. Sidewalls 116 and 118 are shaped to receive the inwardly-extending convex projections 88 and 90 of rotor slot 50 where dovetail 110 is inserted in slot 50. More specifically, in the exemplary embodiment, when dovetail 110 is within slot 50, a gap 144 is defined between radially inner surface 115 of dovetail 110 and slot base 82. As described in more detail below, air leakage from one stage 46 to an axially-adjacent downstream stage 46 may undesirably flow through gap 144. In an alternative embodiment, an amount of aluminum may be applied to dovetail 110 and slot base 82 to facilitate reducing air leakage through gap 144. In such an embodiment, the aluminum may be applied using a spraying technique. Moreover, in such an embodiment, sprayed aluminum may have a thickness that is variable and therefore may not completely seal gap 144. Furthermore, the amount of sprayed aluminum used may add additional cost to the assembly of engine 10.

In the exemplary embodiment, rotor blade 48 includes a cavity 142 defined within dovetail 110. Cavity 142 receives cooling air (not shown) therein to facilitate cooling rotor blades 48.

In the exemplary embodiment, dovetail 110 also includes two channels 130 defined therein. More specifically, channels 130 are formed in dovetail 110 using either of electro discharge machining ("EDM") or electro chemical machining ("ECM"). Alternatively, channels 130 may be formed in dovetail 110 using any suitable known machining methods. Channels 130, as described in more detail below, are sized and oriented to receive a sealing assembly 200 (shown in FIGS. 2 and 3) therein, and each include a recessed surface 132 that includes a radially inner sliding surface 140, a radially outer surface 134, an axially outer surface 136, and an axially inner surface 138. More specifically, in the exemplary embodiment, channels 130 are formed such that a radially inner surface 140 of recessed surface 132 is oriented at an oblique angle $\theta$ with respect to radially inner surface 115 of dovetail 110. As described in more detail below, angle $\theta$ is determined as a function of a mass of a dynamic plate 202, the ductile characteristics of a rope seal 206, the pressure of air within the particular stage 46, and the size of gap 144. More specifically, in the exemplary embodiment, angle $\theta$ is selected to facilitate dynamic plate 202 loading rope seal 206 such that gap 144 is substantially sealed by rope seal 206.

Figure 5:
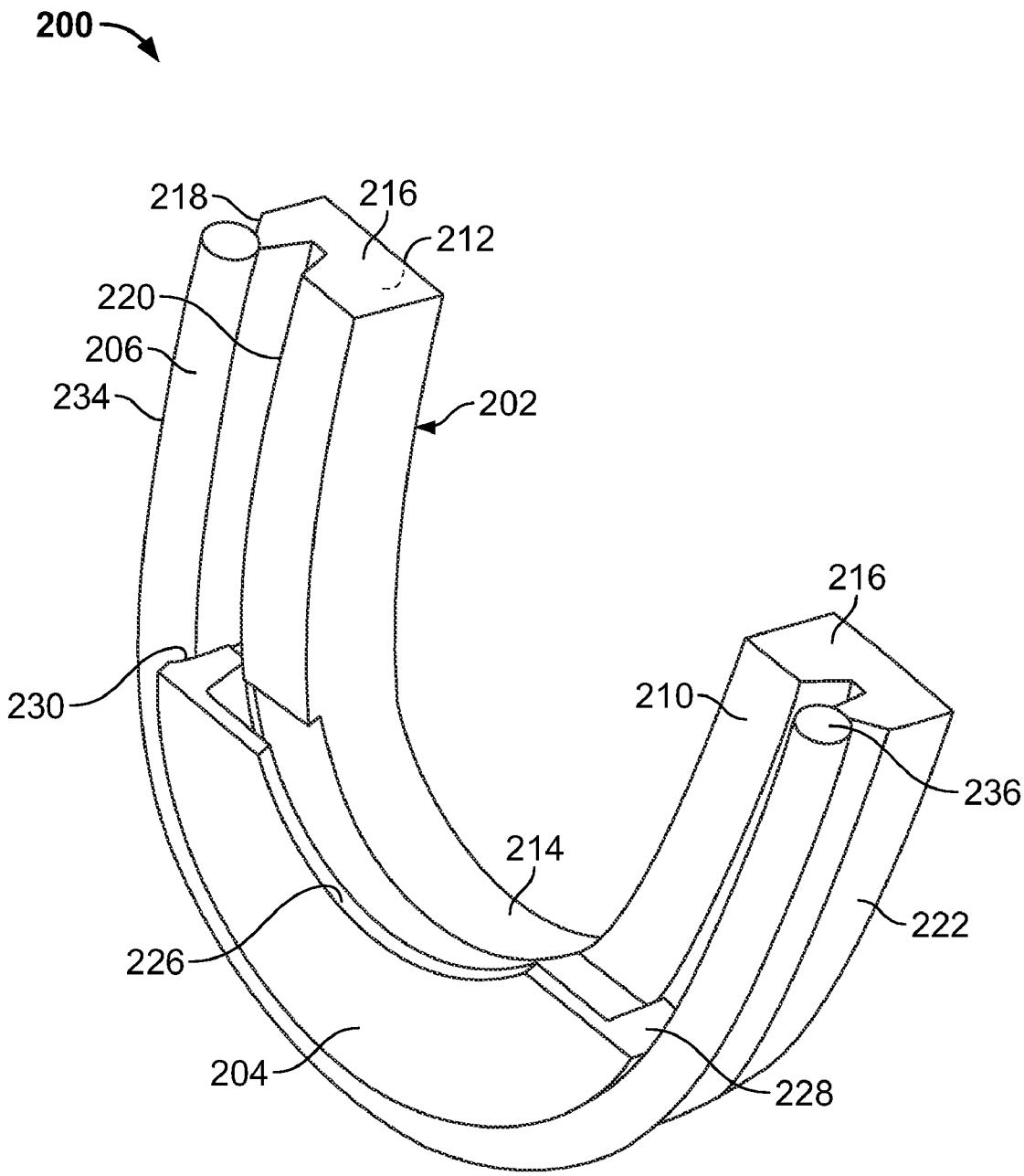
FIG. 5 is a perspective view of a sealing apparatus that may be used with the blade shown in FIG. 4.

FIG. 5 is a perspective view of sealing assembly 200. In the exemplary embodiment, sealing assembly 200 includes dynamic plate 202, a static plate 204, and rope seal 206. In the exemplary embodiment, dynamic plate 202 is generally U-shaped and generally includes a plurality of surfaces. Specifically, in the exemplary embodiment, dynamic plate 202 is defined by a front surface 210, a rear surface 212, an inner surface 214, an outer surface 222, and a pair of end surfaces 216. More specifically, in the exemplary embodiment, front surface 210 includes a contoured edge 218 that extends about an outer periphery of front surface 210 and has a generally U-shape. In one embodiment, contoured edge 218 may include, but not limited to, a chamfered edge, a rounded edge, a cam surface edge, or a splined contoured edge surface. In the exemplary embodiment, front surface 210 also includes a U-shaped channel 220 defined therein. Similarly, in the exemplary embodiment, static plate 204 has a generally U-shape and includes an inner surface 226 and a perimetrical flange 228 that extends outward therefrom. Perimetrical flange 228 includes an outer surface 230. Rope seal 206 includes an exterior surface 234 and a pair of end surfaces 236. In the exemplary embodiment, rope seal 206 is substantially cylindrical. Alternatively, rope seal 206 may have any shape that enables sealing assembly 200 to function as described herein, such as, but not limited to, a rectangular cross-sectional shape and/or a semi-circular cross-sectional shape. As described in more detail below, in the exemplary embodiment, rope seal 206 is fabricated from a material that enables rope seal 206 to be deformed by the application of force by dynamic plate 202. Such as, for example, a ductile metal that may deform.

In the exemplary embodiment, sealing assembly 200 is assembled by coupling static plate 204 to dynamic plate 202 such that flange 228 is slidably coupled within channel 220. Specifically, in the exemplary embodiment, dynamic plate 202 is configured to receive perimetrical flange 228 of static plate 204. Moreover, in the exemplary embodiment, rope seal 206 is coupled to static plate outer surface 230. Once assembled, sealing assembly 200 is inserted within channel 130 such that dynamic plate inner surface 214, static plate inner surface 226, and rope seal exterior surface 234 are each slidably coupled against channel recessed surface 132. Moreover, in the exemplary embodiment, dynamic plate end surfaces 216 and rope seal end surfaces 236 are slidably coupled against radially outer surface 134.

Figure 6:
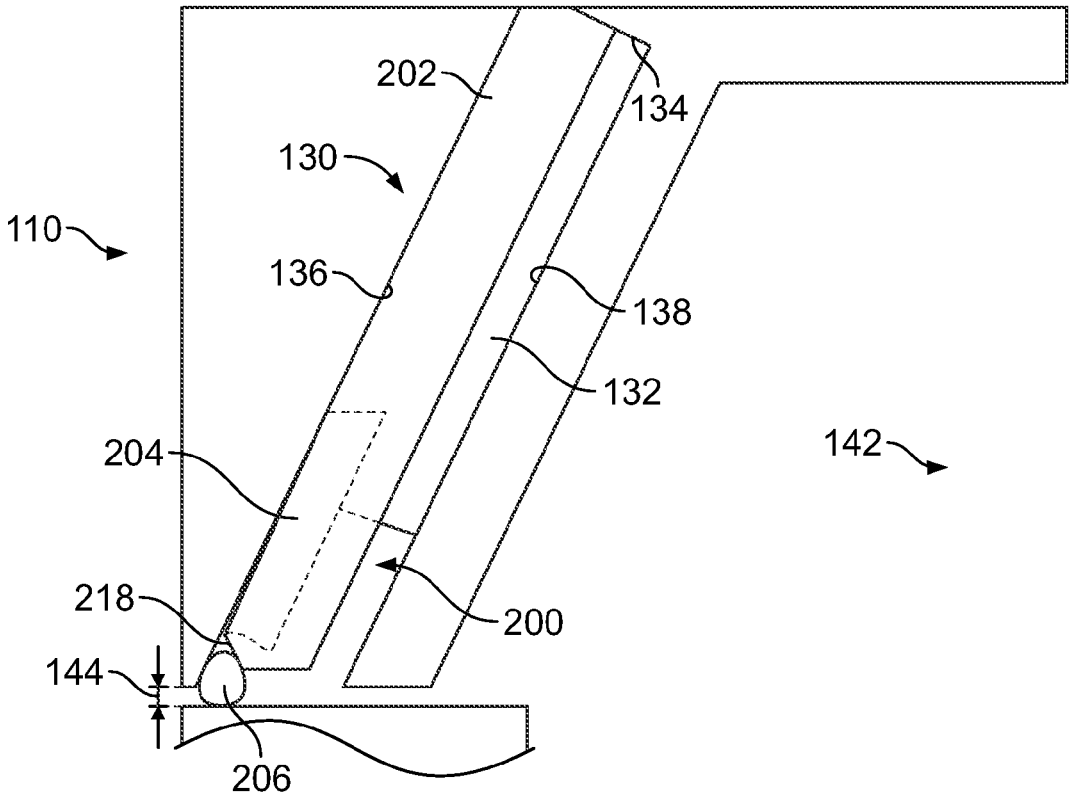
FIG. 6 is a cross-sectional view of the sealing apparatus shown in FIG. 5 and coupled to the blade shown in FIG. 4.

FIG. 6 is an enlarged cross-sectional view of a portion of rotor blade 48 and channel 130 with sealing assembly 200 inserted therein. In FIG. 6, a portion of rope seal 206 has been removed for clarity. In the exemplary embodiment, dynamic plate 202 induces a load force on rope seal 206 and channel outer surface 136. As described in more detail below, in the exemplary embodiment, contoured edge 218 of dynamic plate 202 displaces rope seal 206 from static plate outer surface 230 such that rope seal 206 substantially seals gap 144. As a result, rope seal 206 facilitates preventing air leakage from flowing through gap 144 which further facilitates improving engine efficiency.

In the exemplary embodiment, sealing assembly 200 and/or recessed surface 132 may be coated with a lubricant to facilitate sliding sealing assembly 200 along recessed surface 132. Moreover, in the exemplary embodiment, the lubricant may be a dry film lubricant ("DFL"). Specifically, in the exemplary embodiment, the DFL may be any suitable DFL including, but not limited to, molybdenum disulfide, graphite, or polytetrafluoroethylene ("PTFE") (e.g., available from DuPont of Wilmington, Del. under the name TEFLON® fine powder resin).

As described in more detail below, the lubricant facilitates sliding sealing assembly 200 along recessed surface 132 such that sealing assembly 200 shifts generally outward along surface 132 during engine 10 operation, and shifts generally inward along surface 132 when engine 10 is not operating. Specifically, the DFL reduces a coefficient of friction between sealing assembly 200 and recessed surface 132. In an alternative embodiment, the lubricant may enable sealing assembly 200 to only slide generally outward along recessed surface 132 during a first operation of engine 10, following the installation of rotor blade 48, including sealing assembly 200, within engine 10. In such an embodiment, the lubricant facilitates sliding sealing assembly 200 generally outward along recessed surface 132 into a sealing position, as described below. Specifically, in such an embodiment, as operating temperatures of engine 10 increases, the lubricant may oxidize facilitating increasing the coefficient of friction between sealing assembly 200 and recessed surface 132. As a result, in such an embodiment, sealing assembly 200 may be substantially fixed in a sealing position, as described below. Alternatively, sealing assembly 200 and/or recessed surface 132 may not be coated with any lubricants.

During operation of engine 10, rotor disk 56 and rotor blades 48 rotate about longitudinal axis 11. As rotor disk 56 rotates, a centrifugal force is generated and is induced to sealing assembly 200. More specifically, the load induced by the centrifugal force increases as the rate of rotor disk rotation increases. As a result, rotor blades 48 have a force applied in a radially outward direction. In the exemplary embodiment, as the rotor disk increases in speed, a load is induced to dynamic plate 202 causing dynamic plate 202 to shift generally outward along recessed surface 132. Specifically, in the exemplary embodiment, as a result of the movement, dynamic plate 202 contacts rope seal 206 such that static plate perimetrical flange 228 is received within dynamic plate channel 220. More specifically, in the exemplary embodiment, the loading induced to sealing assembly 200 causes dynamic plate contoured edge 218 to contact rope seal 206 such that rope seal 206 is positioned against contoured edge 218 and channel outer surface 136. Moreover, in the exemplary embodiment, as the load induced to sealing assembly 200 increases, the load enables dynamic plate contoured edge 218 to deform rope seal 206 such that rope seal 206 is separated from static plate outer surface 230. As a result, the load causes dynamic plate 202 to shift generally outward along recessed surface 132 into a sealing position such that dynamic plate contoured edge 218 is positioned substantially between outer surface 230 of static plate 204 and rope seal 206. As a result, contoured edge 218 facilitates expanding rope seal 206 generally outward from outer surface 230 such that rope seal 206 extends into gap 144 to facilitate sealing thereof. Moreover, in the exemplary embodiment, rope seal 206 is coupled to slot base 82 and axially outer surface 136 such that gap 144 is substantially sealed by rope seal 206.

In the exemplary embodiment, dynamic plate 202 facilitates expanding rope seal 206 such that rope seal facilitates sealing of gap 144. As gap 144 is sealed, airflow through gap 144 is facilitated to be reduced. The reduction of leakage between upstream and downstream portions of rotor disk 56 facilitates increases engine performance and efficiency by reducing energy losses.

Described herein is an exemplary sealing assembly that facilitates reducing and/or eliminating undesirable airflow between an upstream portion of a rotor disk and a downstream portion of the rotor disk. More specifically, the sealing assembly is coupled within each rotor blade coupled to a rotor disk of a gas turbine engine turbine assembly. The sealing assembly includes a rope seal that deforms during rotor operation to substantially seal a gap defined between the rotor blade and the rotor disk using centrifugal force.

More specifically, the sealing assembly described herein facilitates improving gas turbine engine performance by reducing and/or preventing air leakage through and between stages of the rotor assembly. The reduction and/or prevention of leakage through the gap defined between the rotor blade and the rotor disk facilitates reducing the amount of sprayed aluminum that may be applied to a dovetail of the rotor blade and a slot base of the rotor disk. As a result, the exemplary embodiment effectively seals the gap and increases engine performance and efficiency while reducing the amount of spayed aluminum that may be applied to the dovetail and the rotor disk.

While the invention has been described in terms of various specific embodiments, those skilled in the art will recognize that the invention can be practiced with modification within the spirit and scope of the claims.

What is claimed is:

1. A method of assembling a rotor assembly, said method comprising:

forming at least one channel in a dovetail portion of at least one rotor blade assembly, wherein the rotor blade assembly includes an airfoil extending outwardly from the dovetail portion;

inserting a sealing assembly within the at least one channel of the dovetail portion, wherein the sealing assembly includes a rope seal coupled to a static plate, and a dynamic plate; and coupling the at least one rotor blade assembly to a rotor disk using the dovetail portion such that at least a portion of the sealing assembly is between the dovetail portion and the rotor disk.

2. A method in accordance with claim 1 wherein forming at least one channel comprises forming at least one channel at an oblique angle with respect to a lower surface of the dovetail portion.

3. A method in accordance with claim 2 wherein forming at least one channel further comprises forming at least one channel using one of electrical discharge machining and electro chemical machining.

4. A method in accordance with claim 1 wherein inserting a sealing assembly within the at least one channel further comprises positioning the sealing assembly to facilitate sealing between the rotor blade assembly and the rotor disk.

5. A method in accordance with claim 1 wherein inserting a sealing assembly further comprises inserting a sealing assembly that includes a rope seal having one of a substantially circular cross-sectional shape, a substantially rectangular cross-sectional shape, and a substantially semi-circular cross-sectional shape.

6. A blade assembly for use in a turbine engine, said blade assembly comprising:

an airfoil;

a dovetail;

a platform extending between said dovetail and said airfoil, said dovetail comprising at least one channel defined in a lower surface of said dovetail; and a sealing assembly inserted within said at least one channel, said sealing assembly comprises a rope seal coupled to a static plate, said static plate is coupled to a dynamic plate, said sealing assembly configured to facilitate sealing between said dovetail and a rotor disk.

7. A blade assembly in accordance with claim 6 wherein said dynamic plate is substantially U-shaped and comprises a front surface comprising at least one contoured edge and a channel.

8. A blade assembly in accordance with claim 6 wherein said static plate is substantially U-shaped and comprises a platform and a perimetrical flange coupled to said platform and extending axially therefrom, said flange comprises an outer surface and is configured to slidably couple within said channel of said dynamic plate.

9. A blade assembly in accordance with claim 6 wherein said rope seal is substantially U-shaped and removably coupled to said static plate outer surface.

10. A blade assembly in accordance with claim 6 wherein said at least one channel is formed in said dovetail using one of electrical discharge machining and electro chemical machining.

11. A blade assembly in accordance with claim 6 wherein said at least one channel comprises a radially inner surface having an angle oblique with respect to a radially inner dovetail surface.

12. A blade assembly in accordance with claim 6 wherein said rope seal comprises one of a substantially circular cross-sectional shape, a substantially rectangular cross-sectional shape, and a substantially semi-circular cross-sectional shape.

13. A blade assembly in accordance with claim 6 wherein said dynamic plate is configured to deform said rope seal using said contoured edge.

* * * * *